United States Patent [19]

Henning

[11] 4,240,684

[45] Dec. 23, 1980

[54] TOOL BOX INCLUDING A PLURALITY OF ROTATING NESTED PYRAMIDAL TOOL RACKS

[76] Inventor: Jack H. Henning, 5002 S. Greenway Dr., Tucson, Ariz. 85706

[21] Appl. No.: 51,538

[22] Filed: Jun. 25, 1979

[51] Int. Cl.[3] ..... A47B 31/00

[52] U.S. Cl. ..... 312/202; 312/125; 312/135; 312/Dig. 33; 312/252; 312/284; 312/305

[58] Field of Search ..... 312/DIG. 33, 125, 135, 312/202, 215, 252, 244, 305, 284

[56] References Cited

U.S. PATENT DOCUMENTS

| | | | |
|---|---|---|---|
| 720,504 | 2/1903 | Tracey | 312/135 |
| 1,719,146 | 7/1929 | Stringer | 312/125 |
| 4,119,044 | 10/1975 | Hines | 312/DIG. 33 |

*Primary Examiner*—Casmir A. Nunberg
*Attorney, Agent, or Firm*—Cahill, Sutton & Thomas

[57] ABSTRACT

A tool box includes a base and a plurality of nested pyramidal tool racks concentrically and rotatably mounted on a rigid vertical rod extending perpendicularly from the base. Each of the pyramidal tool racks except the innermost core has a removable side. Each removable side can be removed, exposing the sides of another smaller pyramidal tool rack nested within the pyramidal tool rack from which that side is removed. A variety of clips are attached to the outer surfaces of the respective pyramidal tool racks for supporting various types of tools. An outer cover shell having a top handle associated therewith is positioned over the outer pyramidal tool rack and is lockable to the top of the vertical rod.

13 Claims, 3 Drawing Figures

TOOL BOX INCLUDING A PLURALITY OF ROTATING NESTED PYRAMIDAL TOOL RACKS

BACKGROUND OF THE INVENTION

1. Field of the Invention

The invention relates to tool boxes, and more particularly, to portable tool boxes containing a plurality of nested tool racks.

2. Description of the Prior Art

Numerous tool boxes, chests, racks, and the like have been proposed or utilized for carrying different types of tools. Some workers, especially mechanics, require easy and convenient access to large numbers of relatively small tools, such as sets of open end wrenches, box end wrenches, numerous screwdrivers of various types and sizes, various sets of rachet-type socket wrenches, numerous sockets and adaptors used therewith, different types of pliers, cutters, drill bits, etc. ad infinitum. Further, such workers often find it desirable to carry a rather large supply of miscellaneous small parts useful in their work, such as bolts, nuts, washers, screws, fuses, etc., in their tool boxes. Large, expensive tool chests having numerous drawers, trays, and racks therein are commonly utilized in garages and shops. Such tool chests are often supported on casters and can be easily moved about a shop. However, such tool chests are not sufficiently portable to allow a mechanic to carry an adequate supply of tools and parts with him when he is required to perform tasks away from the shop.

Accordingly, it is an object of the invention to provide a compact tool chest capable of carrying a large number and variety of tools.

Since many workers, especially mechanics, use their own tools in their work, and since loss of tools due to theft is a particularly vexing problem, it is essential that a tool box in which a mechanic keeps his numerous personally owned tools be secure against theft of tools stored therein.

It is therefore another object of the invention to provide a compact tool box capable of carrying a large number and variety of tools, which tool box is easily and securely lockable to prevent theft of tools therein.

The large tool chests, especially those containing many compartments and drawers, mentioned above, are very expensive and are unduly large and bulky.

Accordingly, it is yet another object of the invention to provide a portable tool chest capable of carrying a large number and variety of mechanic's tools, which tool chest is less expensive and smaller in size than prior tool chests having the same tool carrying capacity.

A mechanic, when working on a particular task, often requires the utilization of a large number of different tools in order to accomplish that task. Previous tool boxes having the capacity of containing a large number of tools usually have a nomber of compartments in which large numbers of different tools are stashed or stored, often in a disorderly fashion. In some tool boxes, large numbers of unrelated tools or even related tools are necessarily stacked together due to the relatively small number of suitable drawers, compartments, or trays, so that it is difficult for the mechanic to quickly find precisely the tool needed. This is, of course, the cause of considerable frustration and inefficiency for mechanics. There is a great unmet need for a low cost tool box which is capable of conveniently and quickly displaying all of the tools contained therein and allowing immediate and rapid access to any particular tool when it is needed.

Therefore, it is still another object of the invention to provide a tool box capable of storing a large number and variety of mechanic's tools, which tool box provides convenient and rapid display of and access to any tool or part stored therein.

SUMMARY OF THE INVENTION

Briefly described, and in accordance with one embodiment thereof, the invention provides a tool rack assembly including an outer rack. An inner rack is concentrically and rotatably disposed within the outer rack. The outer rack includes a plurality of tool supporting panels, one of them being a removable tool supporting panel. The tool supporting panels at least partially enclose a first region. A plurality of tool supporting elements, incuding pegs and clips, are attached to the outer surfaces of each of the respective tool supporting panels.

In the described embodiment of the invention, the tool supporting panels are trapezoidally shaped, four of them comprising the sides of the outer rack. The inner rack is smaller in size than the outer rack, and also includes four trapezoidally shaped tool supporting panels each having a plurality of tool supporting pegs and/or clips attached thereto. A bearing assembly is disposed between the bottom of the inner rack and the bottom of the outer rack, permitting the inner rack to reely rotate within the outer rack. When the removable tool supporting panel is removed from the outer rack, a user can easily rotate the inner rack and reach any tool supported by the inner rack.

In the described embodiment of the invention, one side of the inner rack is also removable, and a lazy susan-type of assembly of trays are concentrically and rotatably disposed within the inner rack. The outer rack is rotatably disposed upon a square base having a plurality of casters thereon. A second bearing assembly is positioned between the bottom of the outer rack and the square support. A rigid vertical rod extends from the support through aligned holes in the tops and bottoms of the inner and outer racks. An outer shell or cover having a square top and four trapezoidally shaped sides has a centered hole in its top. The vertical rod extends through the centered hole. A transverse hole extends through the top of the rod. A handle having an upper gripping member and a lower plate member has a hole in the lower plate. The top of the rod extends through the hole in the lower plate member and a lock element passes through the transverse hole, engaging the handle to the vertical rod and hence to the tool rack assembly, and thereby also securing the cover or shell to the tool rack assembly, preventing theft of the tools. The lower edges of the cover rest against the sides of the square support. The described tool rack assembly is constructed of lightweight tempered aluminum or any other suitable material.

DESCRIPTION OF THE INVENTION

Figure 1:
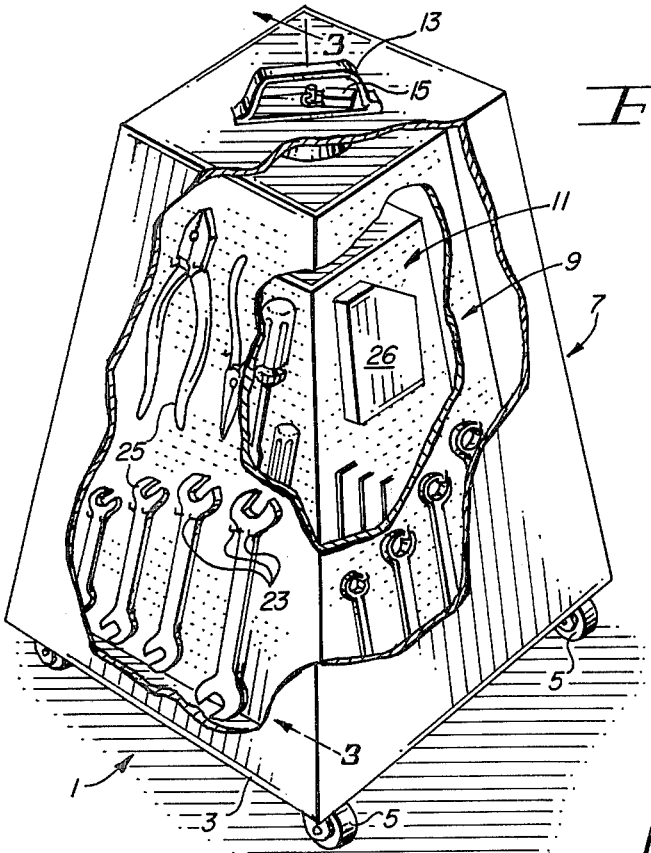
FIG. 1 is a partial cutaway perspective view of the tool box of the present invention.

Referring now to FIG. 1, tool rack 1 includes a base plate 3. Four casters 5 are mounted on the underside of base plate 3.

Figure 2:
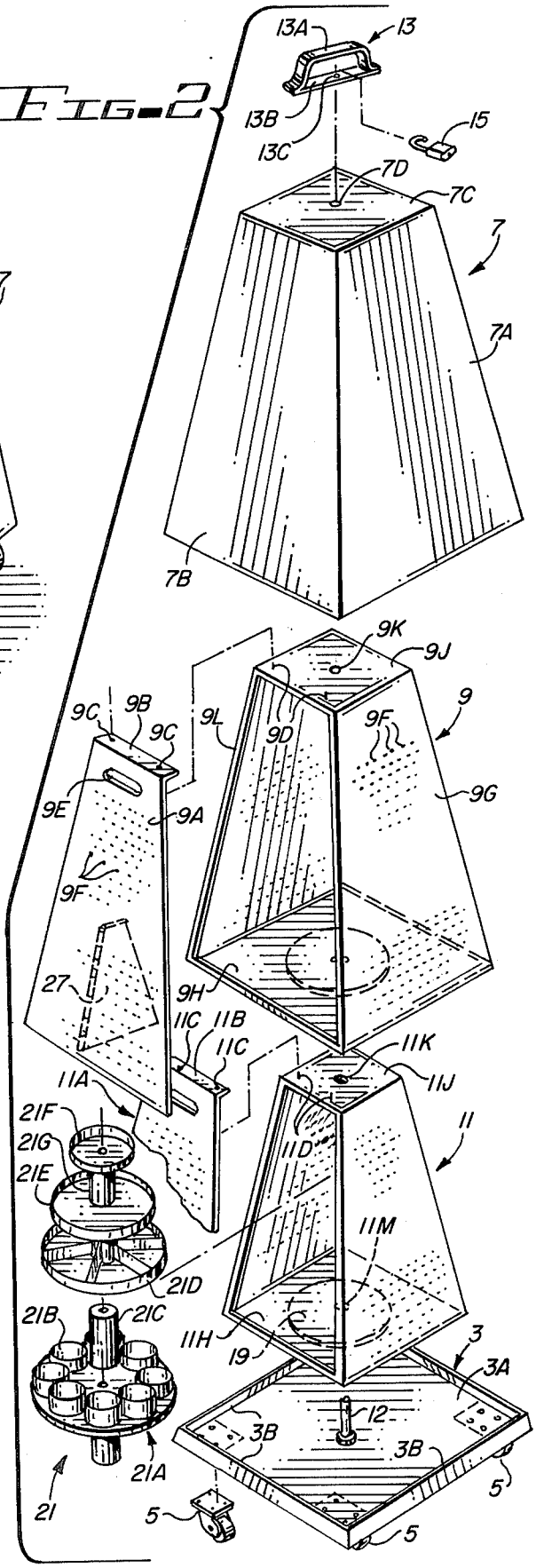
FIG. 2 is an exploded view illustrating the tool box of FIG. 1.
Figure 3:
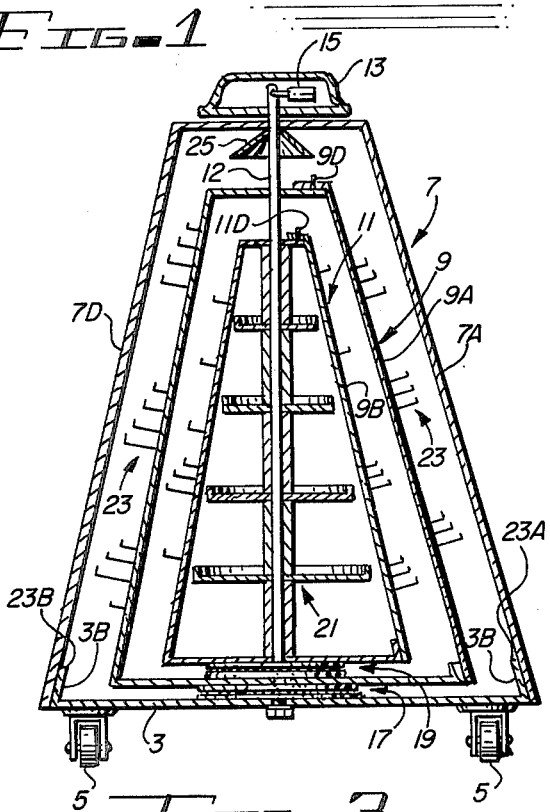
FIG. 3 is a sectional view taken along section lines 3—3 of FIG. 1.

Referring now also to FIGS. 2 and 3, cover or shell 7 includes four trapezoidally-shaped sides, including sides 7A, 7B and 7D. Cover 7 also includes a square top 7C having a central hole 7D therein. A vertical rod 12 is rigidly attached to base 3 and extends through hole 7D in the top 7C of cover 7. The upper end of rod 12 also extends through hole 13C in bottom plate 13B of handle 13. Handle 13 has a curved gripping member 13A. A transverse hole through the upper end of shaft 12 receives lock 15, securing handle 13 to the top of rod 12 and enabling a user to carry tool rack 1 and also securing cover 7 to base 3 to prevent theft of tools stored in tool rack 1.

As best seen in FIGS. 2 and 3, base 3 has a square shape, and includes four peripheral members 3B attached to bottom plate 3A. Each of members 3B extends upwardly from bottom plate 3A at an angle which corresponds to the angle at which the sides of cover 7 extend upwardly with respect to bottom plate 3A.

As best seen in FIG. 3, a pair of rails 23A and 23B are attached to the inner surface of sides 7A and 7D of cover 7, respectively. The lower edges of rails 23A and 23B rest on corresponding ones of peripheral members 3B, thereby supporting the weight of cover 7 on base 3. A pair of corresponding rails, not shown, are similarly disposed on the inner surfaces of the other two trapezoidal sides of cover 7.

Two tool racks, outer rack 9 and inner rack 11 are nested within cover 7. As can be readily seen from FIGS. 2 and 3, each of racks 9 and 11 has four trapezoidal sides or tool supporting panels, a square bottom, and a square top. Outer rack 9 and inner rack 11 are described herein as being pyramidal in shape, even though their sides are trapezoidal rather than triangular. Each of the four sides or tool supporting panels of each of racks 9 and 11 has a large number of spaced perforations or clip receiving holes therein. A variety of clips, pegs, and the like, are securely inserted in such clip receiving holes, enabling a wide variety of tools 25, including pliers, dikes, cutters, a wide variety of open end and box end wrenches, screwdrivers, drill bit cases such as 26, ad infinitum, to be hung or supported on the respective trapezoidal sides.

At this point it should be noted that in order to gain access to racks 9 and 11 and the tools supported thereon, lock 15 is unlocked and removed from the transverse hole through the top of rod 11, handle 13 is removed and cover 7 is lifted off of base 3 and set aside.

Referring particularly to FIGS. 2 and 3, it is seen that rack 9 includes three fixed trapezoidal sides or tool supporting panels including 9G and 9L, a square top 9J having a centrally disposed hole 9K therein, and a larger square bottom 9H having a centrally disposed hole 9M therein. Rack 9 also includes a removable trapezoidal tool supporting panel 9A having a flange 9B at its upper edge. Flange 9B has two holes 9C therein which mate with or receive two vertical pegs 9D extending upwardly from the corresponding edge of top 9J to retain panel 9A on outer rack 9. A finger hole 9E in removable trapezoidal side 9A permits a user to easily remove panel 9A from rack 9 by lifting it up so that flange 9B slides off of vertical pegs 9D or to lower panel 9A so that pegs 9D extend through holes 9c of flange 9B.

Removable trapezoidal tool supporting side or panel 9A includes a hingable support 27 hingably attached to the inner surface of panel 9A so that when panel 9A is removed to expose the interior of rack 9, support 27 can be pivoted or swung outward and placed on the ground so that support 27 holds removable panel 9A in its upright position. The user thereby can conveniently place movable panel 9A so that he has immediate and convenient access to any tools supported by appropriately positioned pegs or clips inserted in the peg holes 9F of removable panel 9A.

As shown in FIG. 3, rack 9 rests on a "lazy susan" bearing 17, which permits rack 9 to freely rotate with respect to base 3. Rod 12 extends through the center of lazy susan bearing 17 and holes 9M and 9K in bottom 9H and top 9J, respectively, of rack 9. (Lazy susan type bearings are readily available commercially, and are not described in detail herein. They include two plates with aligned circular grooves. The circular plates are positioned face-to-face, and a large number of ball bearings are rotatably held between the circular grooves.) Inner rack 11 is constructed similarly to outer rack 9, except that inner rack 11 is smaller and, as readily seen from FIG. 3, is concentrically nested within outer rack 9. (It should be noted that the exploded view of FIG. 2 shows inner rack 11 positioned below, rather than inside of outer rack 9, for convenience of illustration.)

More specifically, inner rack 11 includes square top 11J and square bottom 11H, and three trapezoidal tool supporting sides or panels rigidly attached thereto. Inner rack 11 also includes a removable panel 11A having a flange 11B with holes 11C. Holes 11C mate with pegs 11D, which extend from top 11J in the manner described above.

As best seen in FIG. 3, inner rack 11 is concentrically mounted with respect to outer rack 9, with rod 12 extending through centrally located hole 11K in top 11J and hole 11M in bottom 11H of outer rack 11. Outer rack 11 rests on a second lazy susan type bearing 19 disposed between the lower surface of bottom 11H of inner rack 11 and the upper surface of bottom 9H of outer rack 11.

Thus, it is seen that easy access to any tool mounted on the respective trapezoidal side panels of inner rack 11 can be attained by merely removing and setting aside removable panel 9A of outer rack 9 and rotating inner rack 11 until the appropriate panel thereof is exposed to the resulting open face of outer rack 9. (As previously explained, the trapezoidal panels of inner rack 11 have perforated clip receiving holes therein and a variety of pegs, clips, etc., supporting various tools thereon in the manner shown in FIG. 1.)

A lazy susan type system of trays 21A, 21B, 21D, 21E and 21F mounted on cylindrical bearings 21C and 21G through which rod 12 extends are disposed within inner rack 11. A variety of suitable containers and trays can be provided on the discs to contain various miscellaneous parts useful to mechanics, such as nuts, bolts, washers, screws, cotter pins, alligator clips, etc., ad infinitum. When both removable side panels 11A and 9A are removed, the user of tool rack 1 can readily obtain access to any of the compartments or trays in assembly 21 simply by spinning the appropriate disc until the desired part is located.

The tool rack 1 described above can be readily fabricated from a wide variety of materials. For example, lightweight tempered aluminum can be utilized for fabrication of the trapezoidal side panels, tops, and bottoms of the inner and outer racks. Rod 12 can be made of steel. The various clips, pegs and tool supports can be made of metal or plastic. One type of an especially useful tool support contains an upper and a lower peg which fit into vertically aligned peg holes in the trapezoidal sides, and has an upwardly extending flange. A plurality of such tool supports have flanges which snugly fit across the diameters of the drive openings of sockets used in socket wrench kits.

Alternate materials from which the trapezoidal side panels can be composed include commonly available peg board or plastic. The described tool box can be cnstructed in a wide variety of sizes, some being suitable for tool boxes which are to be carried frequently in an automobile or truck. Locking type casters or rigid feet can be provided on the bottom of base 3 if it is not desired to avoid rolling of the tool box. And, of course, any suitable number of outer and inner racks can be nested to suit various requirements.

Although the invention has been described with reference to a particular embodiment thereof, those skilled in the art will be able to make various modifications to the described embodiments without departing from the true spirit and scope of the invention set forth in the appended claims.

I claim:

1. A tool rack assembly comprising in combination:

a. an outer rack, said outer rack including
   i. a first tool supporting panel, said first tool supporting panel partially enclosing a first region;
   ii. a removable tool supporting panel, said removable tool supporting panel being engageable to said first tool supporting panel to further enclose said first region;
   iii. a plurality of tool supporting elements attached, respectively, to the outer surfaces of said first tool supporting panel and said removable tool supporting panel;
   iv. means for removably connecting said removable tool supporting panel to said first tool supporting panel, whereby said removable tool supporting panel can be removed, allowing access to said first region through an opening created by removal of said removable tool supporting panel;

b. an inner rack nested in said first region within said outer rack;

c. bearing means attached to said inner rack for rotatably supporting said inner rack within said outer rack enabling a user to conveniently remove said first removable tool supporting panel from said outer rack and enabling the user to easily rotate said inner rack within said outer rack to enable the user to easily reach through said opening to any tool supported on a tool supporting surface of said inner rack; and d. a rigid cover or shell for covering said outer rack to prevent access to said first tool supporting panel and said removable tool supporting panel and further including means for securing said cover or shell over said outer rack.

2. The tool rack assembly of claim 1 wherein said outer rack includes four trapezoidal tool supporting sides or panels, a square top, and a square bottom, each of said trapezoidal sides including means for enabling attachment of said tool supporting elements.

3. The tool rack assembly of claim 2 wherein said bearing means includes a bearing assembly disposed between a bottom of said inner rack and the bottom of said outer rack.

4. The tool rack assembly of claim 1 further including a vertical rod extending from the top of said outer rack through a hole in said cover.

5. The tool rack assembly of claim 4 further including a handle lockably engaged to a portion of said rod extending through said hole in the top of said cover, whereby said handle can be utilized to carry said tool assembly and also lock said cover in position to prevent access to said first tool supporting panel and said removable tool supporting panel.

6. The tool rack assembly of claim 5 wherein said vertical rod extends from the bottom of said outer rack through said inner rack and through the top of said outer rack.

7. The tool rack assembly of claim 3 further including a base, said outer rack being rotatably disposed on said base.

8. The tool rack assembly of claim 7 further including means attached to the bottom of said base for supporting said base.

9. The tool rack assembly of claim 8 wherein said supporting means includes a plurality of casters.

10. The tool rack assembly of claim 2 wherein said inner rack includes four trapezoidal tool supporting panels, a square bottom and a square top, each attached to said trapezoidal sides.

11. The tool rack assembly of claim 1 further including a second inner rack nested within said first inner rack and rotatably disposed therein.

12. A tool rack assembly comprising in combination:

a. an outer rack, said outer rack including
   i. a first tool supporting panel, said first tool supporting panel partially enclosing a first region;
   ii. a removable tool supporting panel, said removable tool supporting panel being engageable to said first tool supporting panel to further enclose said first region;
   iii. a plurality of tool supporting elements attached, respectively, to the outer surfaces of said first tool supporting panel and said removable tool supporting panel;
   iv. means for removably connecting said removable tool supporting panel to said first tool supporting panel, whereby said removable tool supporting panel can be removed, allowing access to said first region through an opening created by removal of said removable tool supporting panel; and b. an inner rack nested in said first region within said outer rack, wherein said removable tool supporting panel includes a hingable stand member attached to the lower inner surface of said removable tool supporting panel for supporting said removable tool supporting panel in an upright position when said removable tool supporting panel is placed on a flat surface.

13. A tool rack assembly comprising in combination:

a. an outer rack, said outer rack including
   i. a first tool supporting panel, said first tool supporting panel partially enclosing a first region;
   ii. a removable tool supporting panel, said removable tool supporting panel being engageable to said first tool supporting panel to further enclose said first region;

iii. a plurality of tool supporting elements attached, respectively, to the outer surface of said first tool supporting panel and said removable tool supporting panel;

iv. means for removably connecting said removable tool supporting panel to said first tool supporting panel, whereby said removable tool supporting panel can be removed, allowing access to said first region through an opening created by removal of said removable tool supporting panel;

b. an inner rack nested in said first region within said outer rack; and c. bearing means attached to said inner rack for rotatably supporting said inner rack within said outer rack enabling a user to conveniently remove said first removable tool supporting panel from said outer rack and enabling the user to easily rotate said inner rack within said outer rack to enable the user to easily reach through said opening to any tool supported on a tool supporting surface of said inner rack.

* * * * *